US005691732A

United States Patent [19]

Tsuru et al.

[11] Patent Number: 5,691,732

[45] Date of Patent: Nov. 25, 1997

[54] SURFACE MOUNTED CHASSIS ANTENNA ATOP DIELECTRIC BASE PLATE AND HAVING REMOVABLE EDGE PORTIONS FOR TUNING RESONANCE

[75] Inventors: Teruhisa Tsuru, Kyoto; Mitsuhide Kato, Shiga, both of Japan

[73] Assignee: Murata Manufacturing Co., Ltd., Japan

[21] Appl. No.: 555,762

[22] Filed: Nov. 9, 1995

[30] Foreign Application Priority Data

Nov. 11, 1994 [JP] Japan ..... 6-278032

[51] Int. Cl.[6] ..... H01Q 1/38

[52] U.S. Cl. ..... 343/745; 343/702; 343/828; 343/846

[58] Field of Search ..... 343/828, 702, 343/749, 750, 700 MS, 745, 846; H01Q 1/24, 1/27, 1/36, 1/38

[56] References Cited

U.S. PATENT DOCUMENTS 5,262,792 11/1993 Egashira ..... 343/702

5,467,095 11/1995 Rodal et al. ..... 343/700 MS

FOREIGN PATENT DOCUMENTS

A30508733 4/1992 European Pat. Off. .

A20621653 4/1994 European Pat. Off. .

*Primary Examiner*—Michael C. Wimer

*Attorney, Agent, or Firm*—Majestic, Parsons, Siebert & Hsue

[57] ABSTRACT

An antenna device for surface mounting has a dielectric base plate, a chassis made of an electrically conductive material and attached to the dielectric base plate, a feed electrode and grounding electrodes. The chassis has a planar radiative part facing the upper surface of the dielectric base plate and side walls at its edges. The side walls are provided with slits which separate portions of the side wall into removable parts. The resonance frequency of the antenna device can be adjusted by cutting off and removing one or more of these removable parts of the side walls. These removable parts can be cut off and removed even after the chassis has been attached to the base plate or the antenna device has been mounted to a circuit board.

4 Claims, 4 Drawing Sheets

SURFACE MOUNTED CHASSIS ANTENNA ATOP DIELECTRIC BASE PLATE AND HAVING REMOVABLE EDGE PORTIONS FOR TUNING RESONANCE

BACKGROUND OF THE INVENTION

This invention relates to an antenna device which can be surface-mounted to a circuit board or the like and hence is useful, for example, in a mobile communication system.

FIG. 5 shows a surface-mountable antenna device 111' described in Japanese Patent Application 6-81652 (unpublished) related to U.S. patent application Ser. No. 08/230,857 filed Apr. 21, 1994 and assigned to the assignee herein, now U.S. Pat. No. 5,510,802. This antenna is adapted for use in a mobile communication system and characterized as having a dielectric base plate 112 and a radiative chassis 113' attached to this dielectric base plate 112 with a space 121 therebetween. The radiative chassis 113' is formed by machine-processing an electrically conductive material such as copper or a copper alloy and, as shown in FIG. 6, has a rectangularly shaped planar radiative part 116. Planar first and second attachment parts 117 and 118 are formed by being bent downward from the shorter edges of this rectangularly shaped radiative part 116. A feed electrode 119 and a grounding electrode 120 are formed unitarily at the tip of the first attachment part 117. Slits 120*a* and 118*a* for injecting solder thereinto are provided at the tips of the first and second attachment parts 117 and 118, respectively. The slit 120*a* on the first attachment part 117 is formed in the part where the grounding electrode 120 is provided.

Stopper pieces 131–134, serving as a space-securing means for securing a space between the inner surface of the radiative part 116 and the upper surface of the dielectric base plate 112, are provided on both sides of the first and second attachment parts 117 and 118 so as to come into contact with the upper surface of the dielectric base plate 112, forming the space 121. These stopper pieces 131–134 are formed by bending portions of the radiative part 116 at positions further towards the center (or further away from the shorter edges) of the radiative part 116 than where the radiative part 116 is bent to form the first and second attachment parts 117 and 118 such that they can come into contact with the upper surface of the dielectric base plate 112. There are also side walls 135*a* and 135*b*, formed by bending the longer side edges of the radiative part 116 downward. These side walls 135*a* and 135*b* serve to improve the mechanical strength of the radiative chassis 113'.

As shown in FIG. 7 more in detail, the dielectric base plate 112 is made of a ceramic or synthetic resin material and has a rectangular box-like shape. Grounding electrodes 114*a* and 114*b* are formed on the side surfaces along its longer edges, and connector electrodes 115*a* and 115*b* are formed on the side surfaces along its shorter edges. As shown more clearly in FIG. 8, a planar capacitor electrode 136 is formed inside the dielectric base plate 112 at an intermediate height and parallel to its principal surfaces, electrically connected to the connector electrode 115*a*. A planar grounding electrode pattern 137 is similarly formed inside the dielectric base plate 112 parallel to and below the capacitor electrode 136, electrically connected to the grounding electrodes 114*a* and 114*b*, such that a capacitor is formed with the capacitor electrode 136, the grounding electrode pattern 137 and the portion of the dielectric material of the base plate 112 lying therebetween. In this manner, the antenna device 111' can be made compact and its resonance frequency can be lowered.

When the radiative chassis 113' and the dielectric base plate 112 are assembled together, the base plate 112 is inserted between the first and second attachment parts 117 and 118 of the chassis 113' until the stopper pieces 131–134 come into contact with the upper surface of the base plate 112. The antenna device 111' is completed by soldering the first attachment part 117 to the connector electrode 115*c* and the second attachment part 118 to the connector electrode 115*a*. The soldering can be accomplished dependably by injecting a solder paste into the slits 118*a* and 120*a*. Because the second attachment part 118 and the connector electrode 115*a* are thus electrically connected, a capacitor comprising the capacitor electrode 136 and the grounding electrode pattern 137 as described above comes to be connected between the radiative chassis 113' and the grounding electrodes 114*a* and 114*b*. The stopper pieces 131–134, in contact with the upper surface of the dielectric base plate 112, serve to keep the space 121 between the lower surface of the radiative part 116 and the upper surface of the dielectric base plate 112 so as to limit the radiative loss of electromagnetic waves and improve the gain of the antenna device 111'.

As shown in the equivalent circuit diagram of FIG. 9, the antenna device 111' thus formed may be viewed as being composed of inductive components $L_1$ and $L_2$ and a capacitive component $C_1$. The first inductive component $L_1$ corresponds mainly to the inductance of the radiative part 116 of the chassis 113'. The second inductive component $L_2$ corresponds mainly to the inductance between the feed electrode 119 and the grounding electrode 120 of the chassis 113'. The capacitive component $C_1$ corresponds to the floating capacitance between the grounding electrodes 114*a* and 114*b* of the dielectric base plate 112 and the radiative part 116 of the chassis 113'. In terms of $L_1$, $L_2$ and $C_1$, the resonance frequency $f_0'$ of the antenna device 111' is expressed as follows:

$$f_0'=1/\{(2\pi)\{C_1(L_1+L_2)\}^{1/2}\}.$$

Because the antenna device 111' is compact with its maximum length less than ⅙ of that of common prior art whip antennas, its band width is less than ⅓ of such prior art whip antennas. Accordingly, the resonance frequency $f_0'$ of the antenna device 111' must be more accurately adjusted in order to obtain a desired frequency band width therefor.

The resonance frequency $f_0'$ of the antenna device 111' is adjusted by varying the distance between the feed electrode 119 and the grounding electrode 120 to thereby change the value of the second inductive component $L_2$. Since the shape of the antenna device 111' itself must be modified if the distance between its feed electrode 119 and grounding electrode 120 are to be changed, the desired adjustment of resonance frequency may become impossible after the chassis 113' has been fastened to the dielectric base plate 112 or the antenna device 111' has been mounted to a circuit board. In other words, even where there are fluctuations in the resonance frequency among antenna devices due to their mass production, their resonance frequency may not be adjustable after they are mounted to a circuit board.

SUMMARY OF THE INVENTION

It is therefore an object of this invention, in view of the above, to provide an antenna device of which the resonance frequency can be adjusted even after its assembly has been completed by attaching a radiative chassis to its dielectric base plate or after it has been mounted to a circuit board.

It is another object of this invention to provide such antenna devices of which the resonance frequencies can be adjusted even after they have been mounted if there are fluctuations among them due to their mass production.

An antenna device embodying this invention, with which the above and other objects can be accomplished, may be characterized not only as comprising a dielectric base plate, a chassis made of an electrically conductive material and attached to the dielectric base plate with a space therebetween, a feed electrode and grounding electrodes, but also wherein the side walls are formed with a plurality of removable parts serving as means for adjusting the resonance frequency of the antenna device. Portions of the side walls of an antenna device thus structured can be cut off and removed easily even after the chassis has been attached to the base plate or the antenna device has been mounted to a circuit board, and the inductance of the electrically conductive chassis is thereby increased, thereby reducing the resonance frequency of the antenna device. Fine adjustments of the resonance frequency becomes possible by increasing the number of such removable parts.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

Throughout herein, substantially similar components are indicated by the same numeral and not repetitively described although they may be parts of different antenna devices.

DETAILED DESCRIPTION OF THE INVENTION

Figure 1:
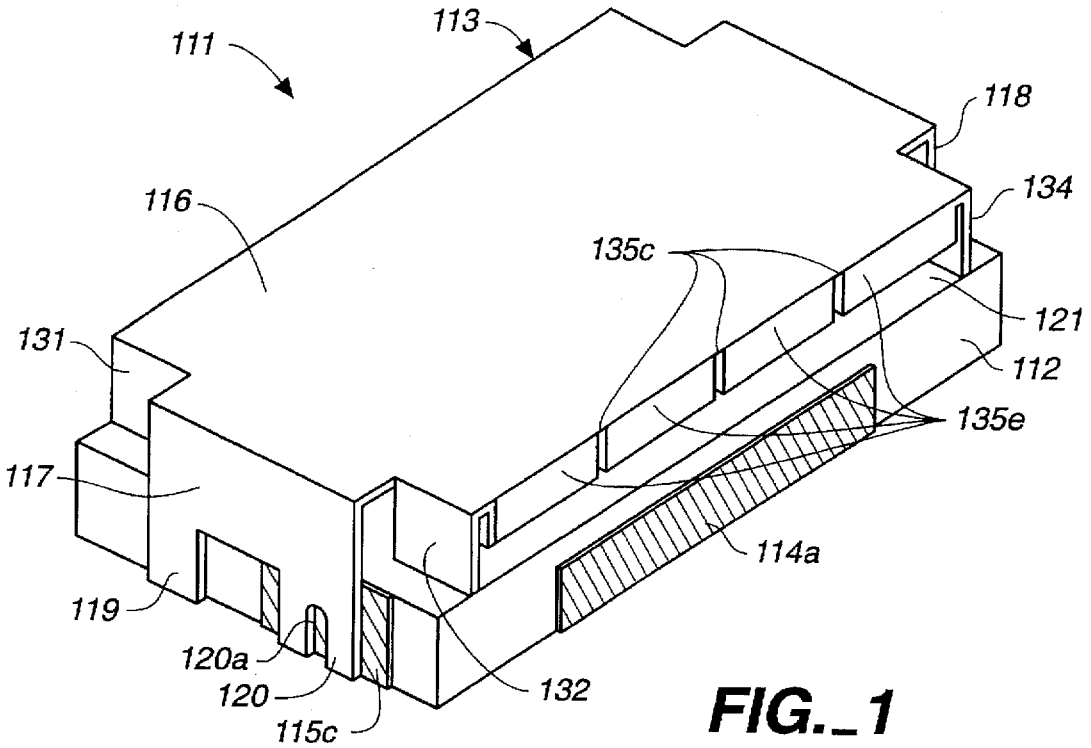
FIG. 1 is a diagonal view of an antenna device embodying this invention.

FIG. 1 shows an antenna device 111 embodying this invention. For the convenience of description, those of its components which are substantially like a component of the prior art antenna device 111' described above are indicated by the same numeral as in FIGS. 5–9.

As shown in FIG. 1, the antenna device 111 according to this embodiment of the invention is formed by attaching a radiative chassis 113 to a dielectric base plate 112 with a space 121 kept above the dielectric base plate 112. This radiative chassis 113 is different from the chassis 113' of the earlier considered antenna device 111' shown in FIGS. 5 and 6 in that the side walls **135*a* and 135*b* of the earlier considered chassis 113' are replaced by a plurality of (four each in the embodiment shown in FIGS. 1 and 2) removable side wall parts 135*e* and 135*f* which are mutually separated by a plurality of (three, respectively, in the embodiment shown in FIGS. 1 and 2) vertical slits 135*c* and 135*d* provided at equal intervals. The chassis 113 and the dielectric base plate 112 are assembled together as explained above for the assembly of the earlier considered antenna device 111'**.

Figure 3:
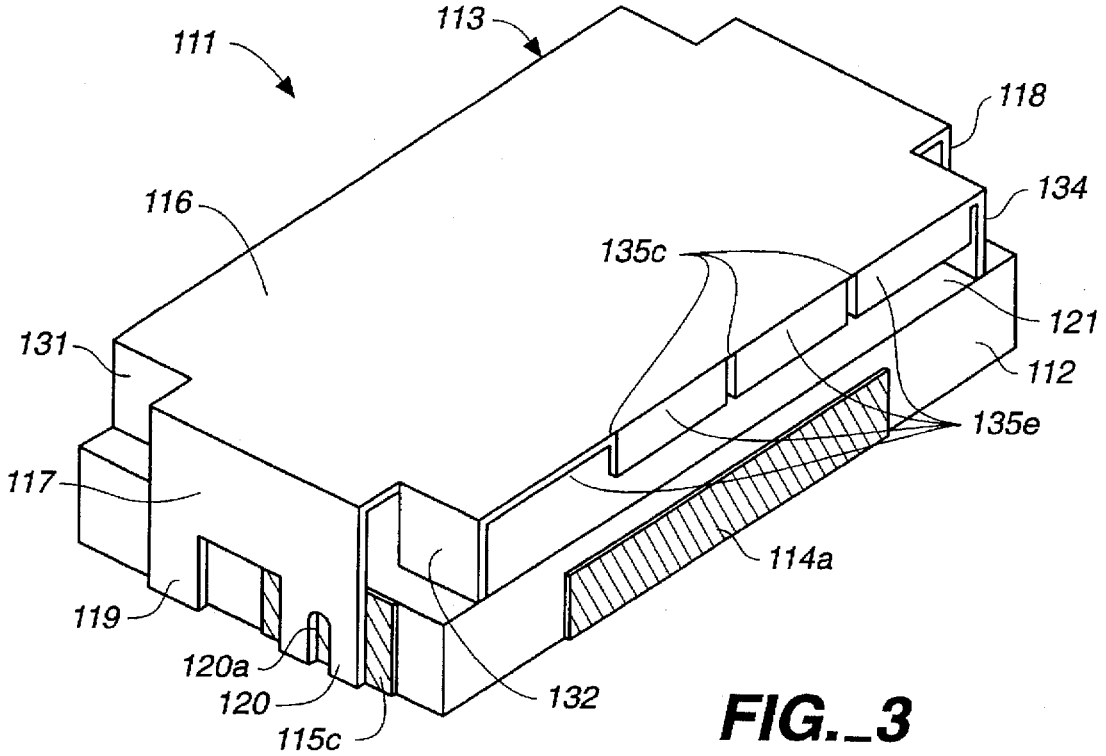
FIG. 3 is a diagonal view of the antenna device of FIG. 1 with one of the removable side wall parts removed.

FIG. 3 shows the antenna device 111 after one of the removable side wall parts **135*e* has been cut off and removed. It is to be appreciated that since these removable side wall parts 135*e* and 135*f* are separated from and independent of the dielectric base plate 112 and the upper surface of a circuit board (not shown), these removable side wall parts 135*e* and 135*f* can be easily cut off and removed even after the chassis 113 has been attached to the dielectric base plate 112 or the antenna device 111** has been mounted.

Figure 4:
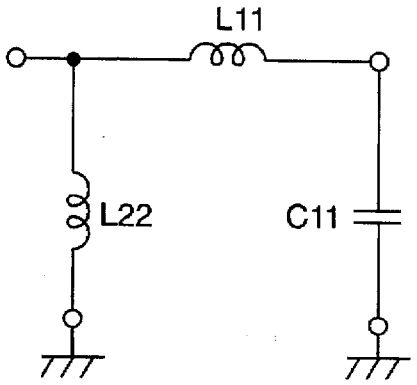
FIG. 4 is an equivalent circuit diagram of the antenna device of FIG. 1.

As shown in the equivalent circuit diagram of FIG. 4, the antenna device 111 thus formed may be viewed as being composed of inductive components $L_{11}$ and $L_{22}$ and a capacitive component $C_{11}$. The first inductive component $L_{11}$ corresponds mainly to the inductance of the radiative part 116 of the chassis 113. The second inductive component $L_{22}$ corresponds mainly to the inductance between the feed electrode 119 and the grounding electrode 120 of the chassis 113. The capacitive component $C_{11}$ corresponds to the floating capacitance between the grounding electrodes **114*a* and 114*b* of the dielectric base plate 112 and the radiative part 116 of the chassis 113. In terms of $L_{11}$, $L_{22}$ and $C_{11}$, the resonance frequency $f_0$ of the antenna device 111** is expressed as follows:

$$f_0=1/\{(2\pi)\{C_{11}(L_{11}+L_{22})\}^{1/2}\}.$$

Figure 5:
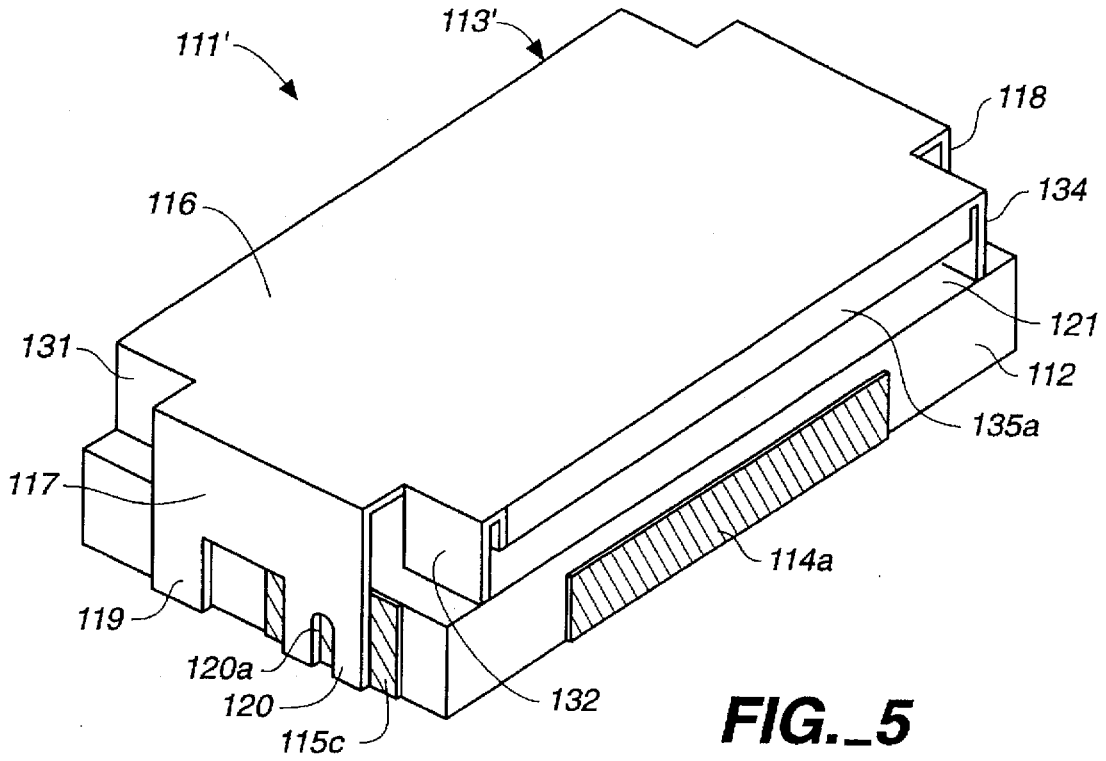
FIG. 5 is a diagonal view of an antenna device considered earlier.
Figure 6:
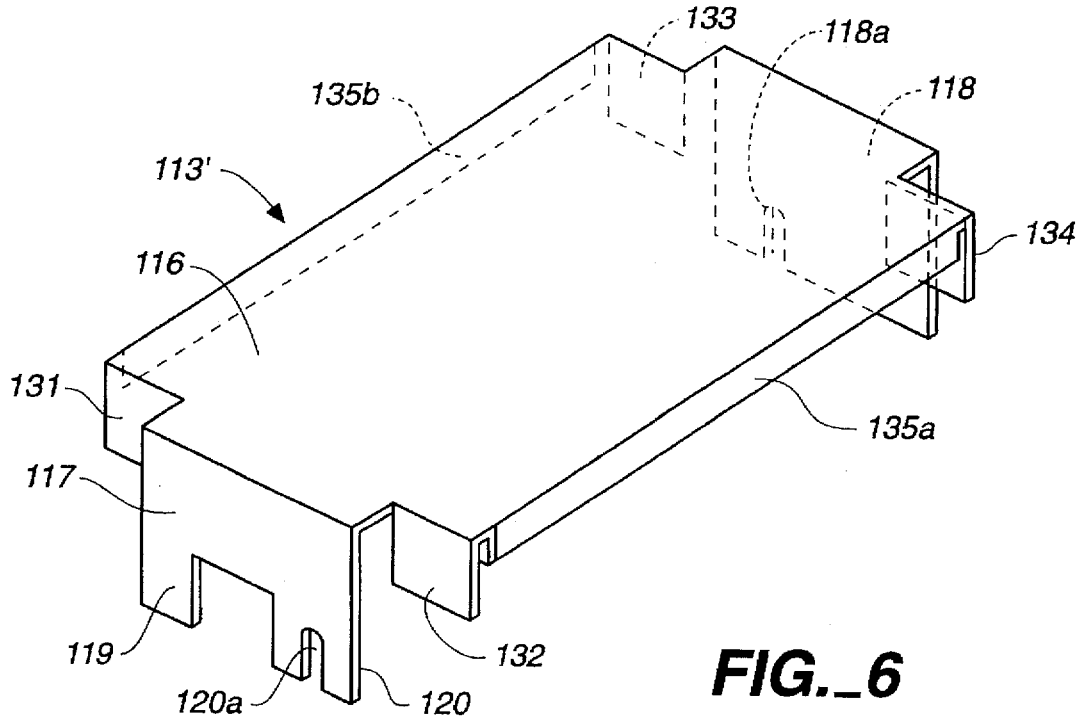
FIG. 6 is a diagonal view of the radiative chassis of the antenna device of FIG. 5.
Figure 7:
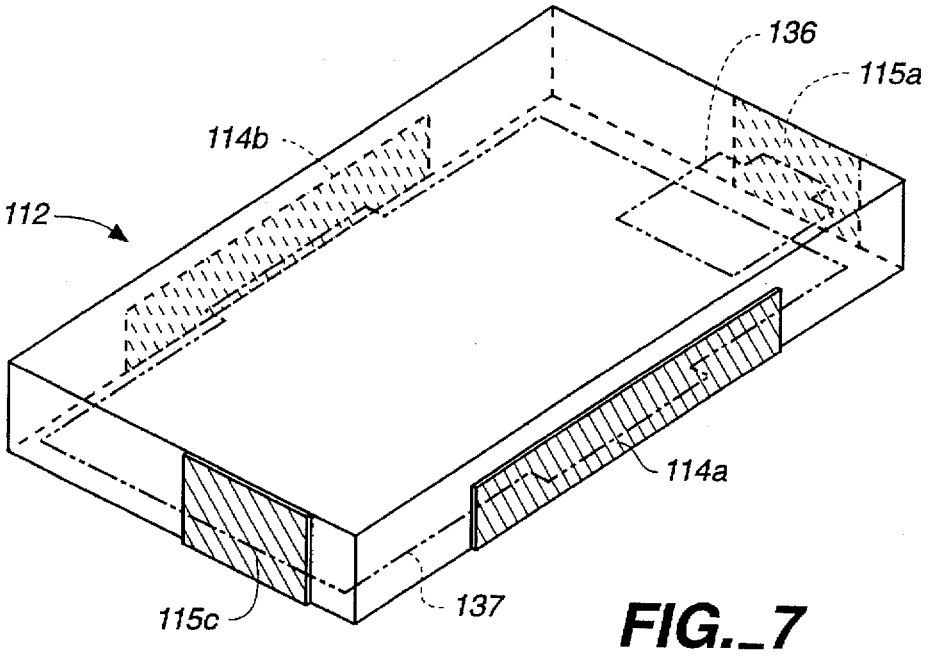
FIG. 7 is a diagonal view of the dielectric base plate of the antenna device of FIG. 5.
Figure 8:
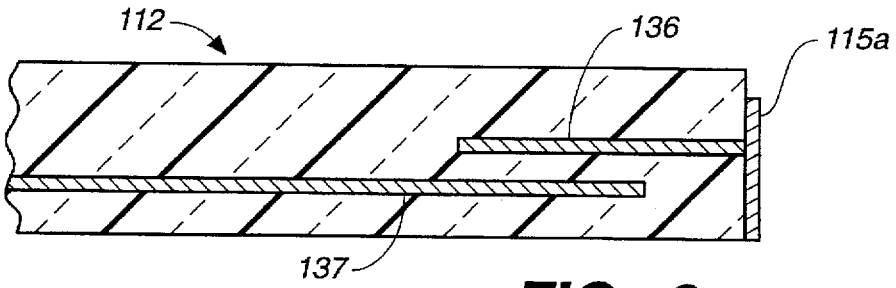
FIG. 8 is a sectional side view of a portion of the dielectric base plate of FIG. 7.
Figure 9:
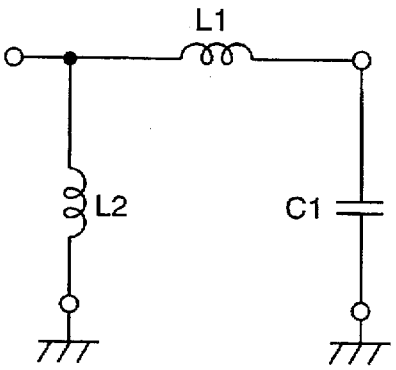
FIG. 9 is an equivalent circuit diagram of the antenna device of FIG. 5.

As each of the removable side wall parts **135*e* and 135*f* is cut off and removed, this has the effect of changing the total area of the side walls 135*a* and 135*b* of the chassis 113' of the earlier considered antenna device 111' shown in FIGS. 5 and 6, or that of increasing the value of the inductive component $L_1$ of the radiative part 116. In other words, the resonance frequency of the antenna device 111 according to this invention can be made smaller. Table 1 shows the change in the resonance frequency $f_0$ as the removable side wall parts 135*e* and 135*f* were cut off and removed one by one. The dimensions of the principal surface of the antennal device 111** used for this measurement were 10 mm×6.3 mm and its height was 4 mm.

TABLE 1

| Number of removable side wall parts that were cut off | Resonance frequency (GHz) |
|---|---|
| 0 | 1.891 |
| 1 | 1.881 |
| 2 | 1.877 |
| 3 | 1.868 |
| 4 | 1.864 |
| 5 | 1.853 |
| 6 | 1.848 |
| 7 | 1.837 |
| 8 | 1.832 |

This shows that the resonance frequency $f_0$ can be made smaller by cutting off and removing an increasing number of removable side wall parts **135*e* and 135*f*. In other words, the resonance frequency $f_0$ of the antenna device 111** is easily adjustable.

Although this invention has been described above with reference to only one example, this example is not intended to limit the scope of the invention. Many modifications and variations are possible within the scope of the invention. For example, the total number of the removable side wall parts 135*e* and 135*f* may be further increased such that the resonance frequency $f_0$ can be more finely adjustable. Grooves may be formed where the removable side wall parts 135*e* and 135*f* are attached to the radiative part 116 so as to facilitate their removal.

Figure 2:
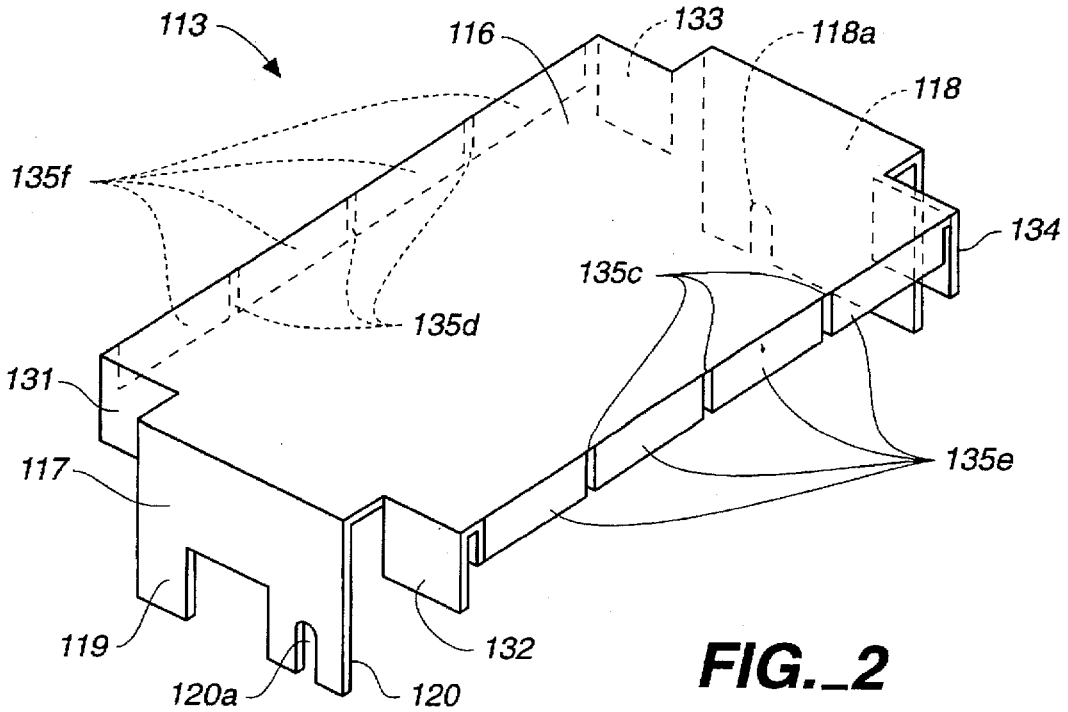
FIG. 2 is a diagonal view of the radiative chassis of the antenna device of FIG. 1.

Although the slits 135*c* and 135*d* are shown in FIGS. 1–3 to extend over the entire height of what corresponds to the side walls 135*a* and 135*b* of the earlier considered chassis 113', these slits 135*c* and 135*d* may be cut from the bottom edges of the side walls to only a part of the way upward to the radiative part 116 such that, even after a removable side wall part 135*e* or 135*f* is cut off and removed, a portion of the downwardly bent portion remains attached to the radiative part 116 and the mechanical strength of the chassis 113 will not be adversely affected.

Furthermore, different means for being partially removed may be substituted if such means also serve to adjust the resonance frequency of the antenna device 111 and to improve the mechanical strength of the radiative chassis 113. Such removable portions may be provided, for example, on the side walls 135*a* and 135*b*.

In summary, an antenna device according to this invention is capable of having its resonance frequency reduced because the inductance due to the radiative part of its chassis becomes large as the area of its side surfaces connected to this radiative part is varied. Its resonance frequency can be adjusted by increasing the number of removable side wall parts to be cut off and removed, and since such removable side wall parts are separate from and independent of the dielectric base plate or the circuit board to which the antenna device is mounted, such adjustments of resonance frequency can be effected even after the radiative chassis has been attached to the dielectric base plate or the antenna device has been mounted to a circuit board.

What is claimed is:

1. An antenna device for surface mounting, comprising:

a dielectric base plate having an upper surface; and a chassis made of an electrically conductive material and attached to said dielectric base plate, said chassis having a horizontal planar radiative part with a lower surface over and opposite said upper surface of said dielectric base plate and side walls at edges of said radiative part, said side walls including removable pieces and attachment walls which are both perpendicular to and bent downward from said radiative part, said removable pieces being adapted to be removed for adjusting resonance frequency of said antenna device, said attachment walls being perpendicular to said removable pieces, said attachment walls each having a feed electrode and a grounding electrode protruding further downward therefrom and being in contact with said base plate.

2. The antenna device of claim 1 wherein said removable pieces are formed as edge portions of said chassis bent from said radiative part.

3. The antenna device of claim 1 wherein said removable pieces are separated from one another by slits.

4. The antenna device of claim 1 wherein said removable pieces are formed such that removal thereof increases the inductive component of said radiative part and decreases the resonance frequency of said antenna device.

* * * * *